US006439022B1

(12) United States Patent
Kamada et al.

(10) Patent No.: US 6,439,022 B1
(45) Date of Patent: Aug. 27, 2002

(54) ROLLING APPARATUS

(75) Inventors: Teruo Kamada; Takashi Tsuchiya; Hideo Yazaki, all of Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/721,360

(22) Filed: Nov. 22, 2000

(30) Foreign Application Priority Data

Nov. 26, 1999 (JP) ..... 11-336790

(51) Int. Cl.[7] ..... B21D 25/04
(52) U.S. Cl. ..... 72/302; 72/161
(58) Field of Search ..... 72/302, 305, 161, 72/205, 206

(56) References Cited

U.S. PATENT DOCUMENTS

| | | | | |
|---|---|---|---|---|
| 2,449,507 A | * | 9/1948 | Pope | |
| 2,727,556 A | * | 12/1955 | Albers | |
| 3,344,637 A | * | 10/1967 | Polakowski | |
| 4,266,418 A | * | 5/1981 | Sakai | |
| 5,579,658 A | | 12/1996 | Noe et al. | |

FOREIGN PATENT DOCUMENTS

| | | | | |
|---|---|---|---|---|
| DE | 1198312 | * | 8/1965 | 72/302 |
| DE | 1452957 | * | 4/1971 | 72/302 |
| JP | 58-81516 | * | 5/1983 | 72/302 |
| JP | 94521 | * | 5/1984 | 72/302 |
| JP | 59-189004 | | 10/1984 | |
| SU | 158862 | * | 11/1963 | 72/302 |
| SU | 264322 | * | 3/1970 | 72/302 |

* cited by examiner

*Primary Examiner*—Daniel C. Crane
(74) *Attorney, Agent, or Firm*—Merchant & Gould, P.C.

(57) ABSTRACT

A rolling apparatus is disclosed which forms a thin walled portion on part of a steel strip by allowing the steel strip to intervene between a pair of upper and lower rolling rolls, in which the upper rolling roll is vertically movable. The steel strip which has been pressed between a pair of upper and lower rolling rolls is repeatedly moved on a traveling table to upstream side and downstream side alternately, thereby forming the thin walled portion having a width corresponding to the movement quantity. In forming the thin walled portion, the steel strip is grasped on both upstream side and downstream side with a plurality of clamping means and is subjected to a tension due to tension imparting means, thereby facilitating formation of the thin walled portion.

4 Claims, 18 Drawing Sheets

θ
86
66
83
86
64
66

81
θ
97
60
66
81
64
66

66
60
90
64
66

ROLLING APPARATUS

BACKGROUND OF THE INVENTION

1. Field of the Invention

The present invention relates to an improved rolling apparatus for forming part of a steel plate into a thin walled portion.

2. Description of the Related Art

As a method for forming part of a steel plate into a thin walled portion, there are generally known a method comprising the step of welding together a plurality of plates of different thickness and a method employing rolling.

FIG. 15A and FIG. 15B hereof illustrate a method for forming part of a steel plate into a thin walled portion by welding.

In FIG. 15A, a differential thickness steel plate 120 having a thin walled portion is shown which is produced by superposing one side end portions of thick plate materials 122, 123 by respective widths t1 and t2 on respective side end portions of a thin plate material 121 and spot welding the thin plate material 121 and thick plate materials 122, 123 together.

In FIG. 15B, a similar differential thickness steel plate is shown which is produced by superposing thick plate materials 122 and 123 on a thin plate material 121 and laser welding the same together. The thick plate materials 122 and 123 have respective angles β and θ on respective end faces thereof. The formation of the angles β and θ is intended to decrease excessive thick plate materials to contrive weight saving of the objective plate.

However, the spot welding as illustrated in FIG. 15A involves such problems as increases in the number of parts and processing steps and lowering of rigidity. In addition, superposing widths t1 and t2 of the thin plate material 121 result in an increase in the overall weight of the differential thickness plate materials 120 by the weight of the superposed portion.

On the other hand, the laser welding as illustrated in FIG. 15B involves such problems as accuracy and precision required in the grooves of the two different plate materials, an increase in the welding apparatus cost and deterioration in the shaping property of welding portions.

To this end, an apparatus for producing a differential thickness plate without the use of welding has been proposed, for example, in Japanese Patent Laid-Open Publication No. SHO-59-189004 entitled "METHOD FOR PRODUCING DIFFERENTIAL THICKNESS PLATE AND ROLLING MILL THEREFOR". The rolling mill for the production of a differential thickness plate produces such a plate by enabling an upside working roll and an underside working roll to be driven and controlled independently of each other, driving the underside working roll in a direction reverse to the driving direction of the upside working roll, and thus roll forming a plate.

However, since in the rolling mill disclosed therein, the upside working roll and underside working roll are driven and controlled independently of each other, control in general such as control for rolling load, rolling speed, plate thickness and the like becomes complicated and this leads to increases in the installation cost, thus increasing the production cost of the differential thickness plate.

SUMMARY OF THE INVENTION

The present invention has been attained to overcome the foregoing problems. It is accordingly an object of the present invention to provide a rolling apparatus capable of producing a differential plate thickness without the use of advanced technique.

According to an aspect of the present invention, there is provided a rolling apparatus comprising: a plurality of clamping means for grasping a steel strip, the clamping means being separated in a direction of transfer of the steel strip; tension imparting means for moving at least one of the clamping means in a tension direction to apply a predetermined tension to the steel strip grasped by the clamping means; a traveling table for reciprocally moving the clamping means and the tension imparting means in unison longitudinally of the steel strip; and a rolling means for pressing down with upper and lower rolling rolls the steel strip grasped by the clamping means placed on the traveling table.

In the above-mentioned rolling apparatus, the steel strip is grasped by the clamping means spaced in a direction of conveyance of the strip. The clamping means are moved by the tension imparting means. While a tension is applied to the steel strip, a thin walled portion is formed on part of the steel strip. The tension, when applied to the thin walled portion, facilitates formation of the thin walled portion with a rolling roll. As a result, a high degree of control is not needed for the rolling means. In addition, by reciprocally moving the strip in a conveying direction, a thin walled portion is formed on part of the steel strip.

In a preferred form. the rolling apparatus is further equipped with a turntable to rotatably support the rolling means. By operating the turntable, the axes of the upper and lower rolling rolls are set non-perpendicularly to the longitudinal direction of the steel strip, thereby enabling the thin walled portion to be formed in a trapezoidal form. Likewise, it is made possible to form the borderline between the thin walled portion and the thick walled portion at a desirable angle and also constitute only a portion requiring strength of the thick walled portion.

It is preferable to provide a heating means for heating the steel strip on both the upstream side and the downstream side of at least either of the upper and lower rolling means, since rolling work of the steel strip is facilitated by heating with the heating means, and the rolling time can be shortened.

BRIEF DESCRIPTION OF THE DRAWINGS

Several preferred embodiments of the present invention will be described in detail below, by way of example only, with reference to the accompanying drawings, in which.

DETAILED DESCRIPTION OF THE PREFERRED EMBODIMENTS

The following description is merely exemplary in nature and is in no way intended to limit the invention, its application or uses.

Figure 1:
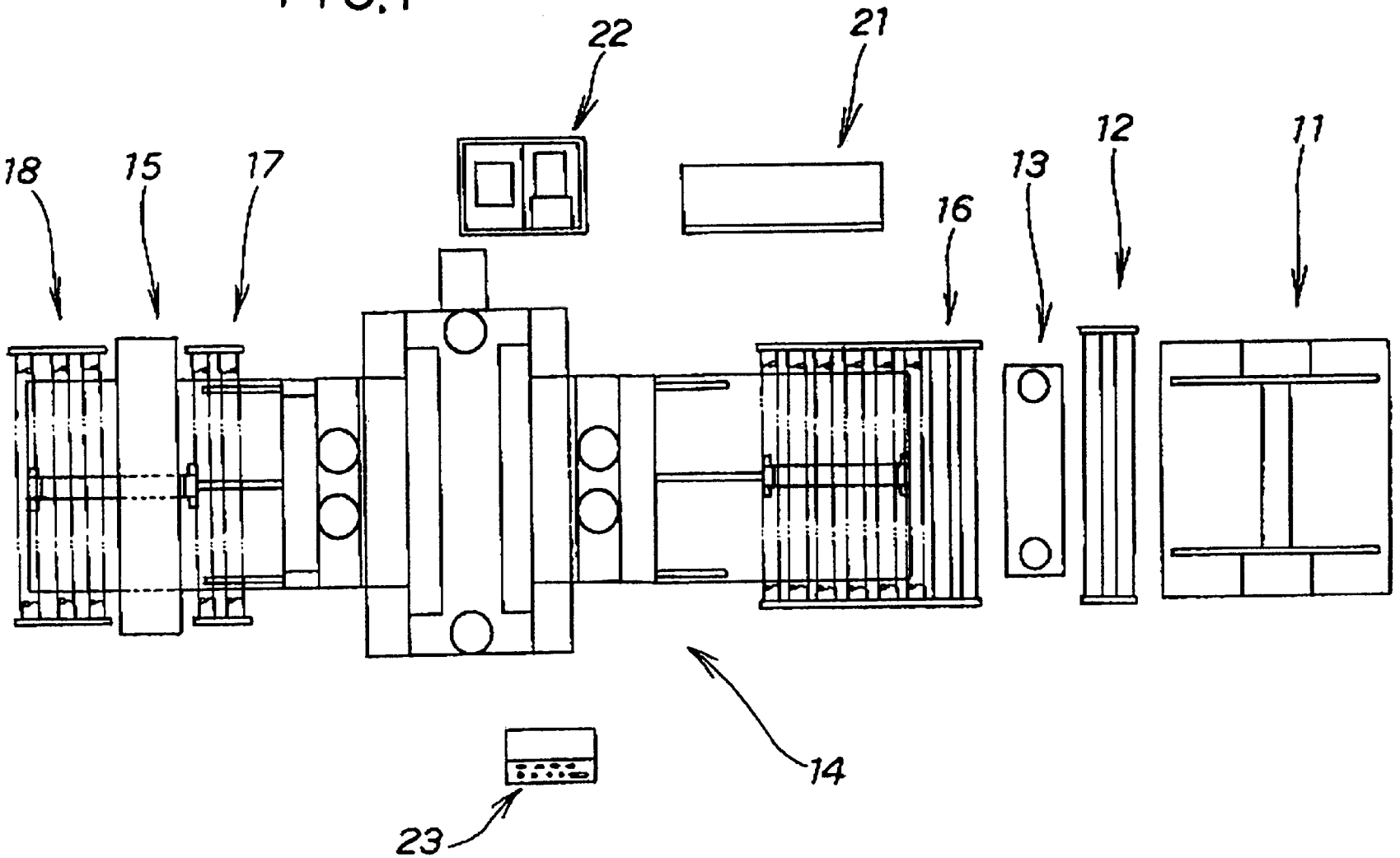
FIG. 1 is a plan view showing a steel strip production line equipped with a rolling apparatus according to a first embodiment of the present invention.
Figure 2:
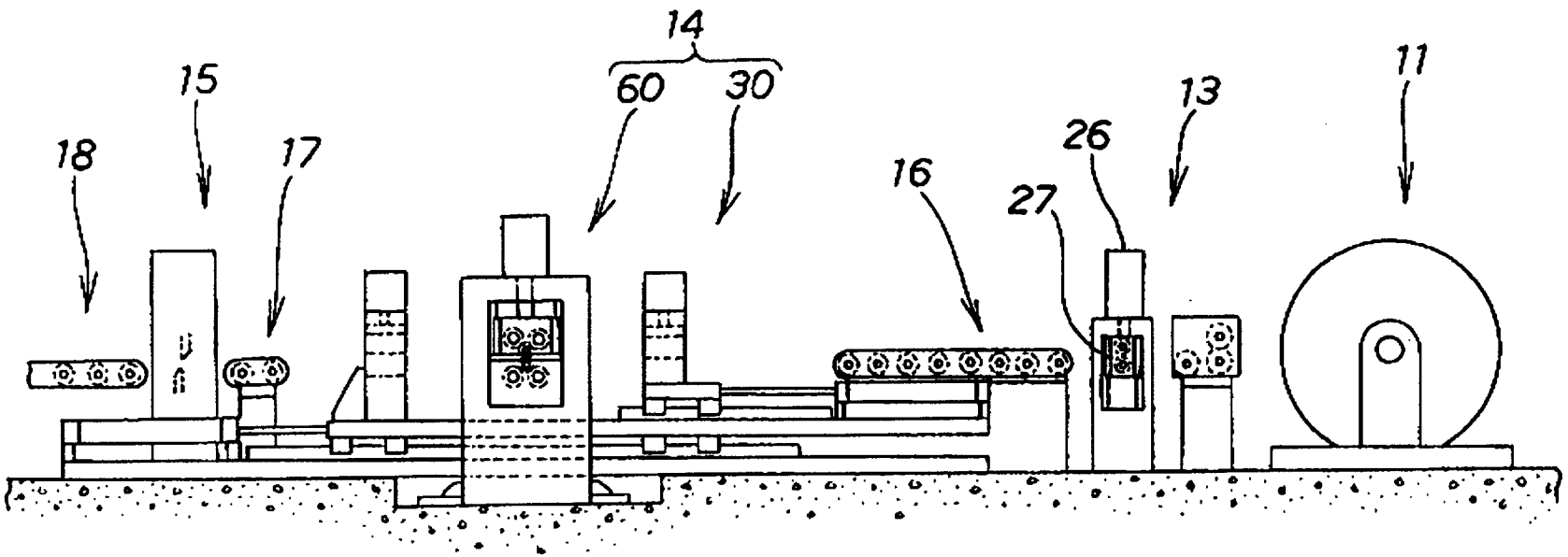
FIG. 2 is a front elevational view of FIG. 1.

FIG. 1 through FIG. 7 illustrate a rolling apparatus according to a first embodiment of the present invention. As shown in FIG. 1 and FIG. 2, a steel strip production line comprises a feed reel 11, a guide portion 12, a loop apparatus 13, a rolling apparatus 14 and a cutting machine 15, which are arranged in this order in series to let out a steel strip from upstream to downstream. Reference numerals 16, 17 and 18 designate roller conveyors. 21, 22 and 23 denote a control board, a hydraulic unit and a control panel, respectively.

The feed reel 11 winds up a continuous steel strip and sends out the same towards the downstream side. The guide portion 12 guides the steel strip let out from the feed reel 11 towards the rolling apparatus 14. The loop apparatus 13 absorbs the sagging of the steel strip when the steel strip is moved to the upstream side in the case of forming a thin walled or reduced thickness portion on the steel strip with the rolling apparatus 14. The cutting machine 15 cuts off the steel strip on which a thin walled portion is formed with the rolling apparatus 14. The rolling apparatus 14 is equipped with a tension apparatus 30 and a rolling means 60.

Figure 3:
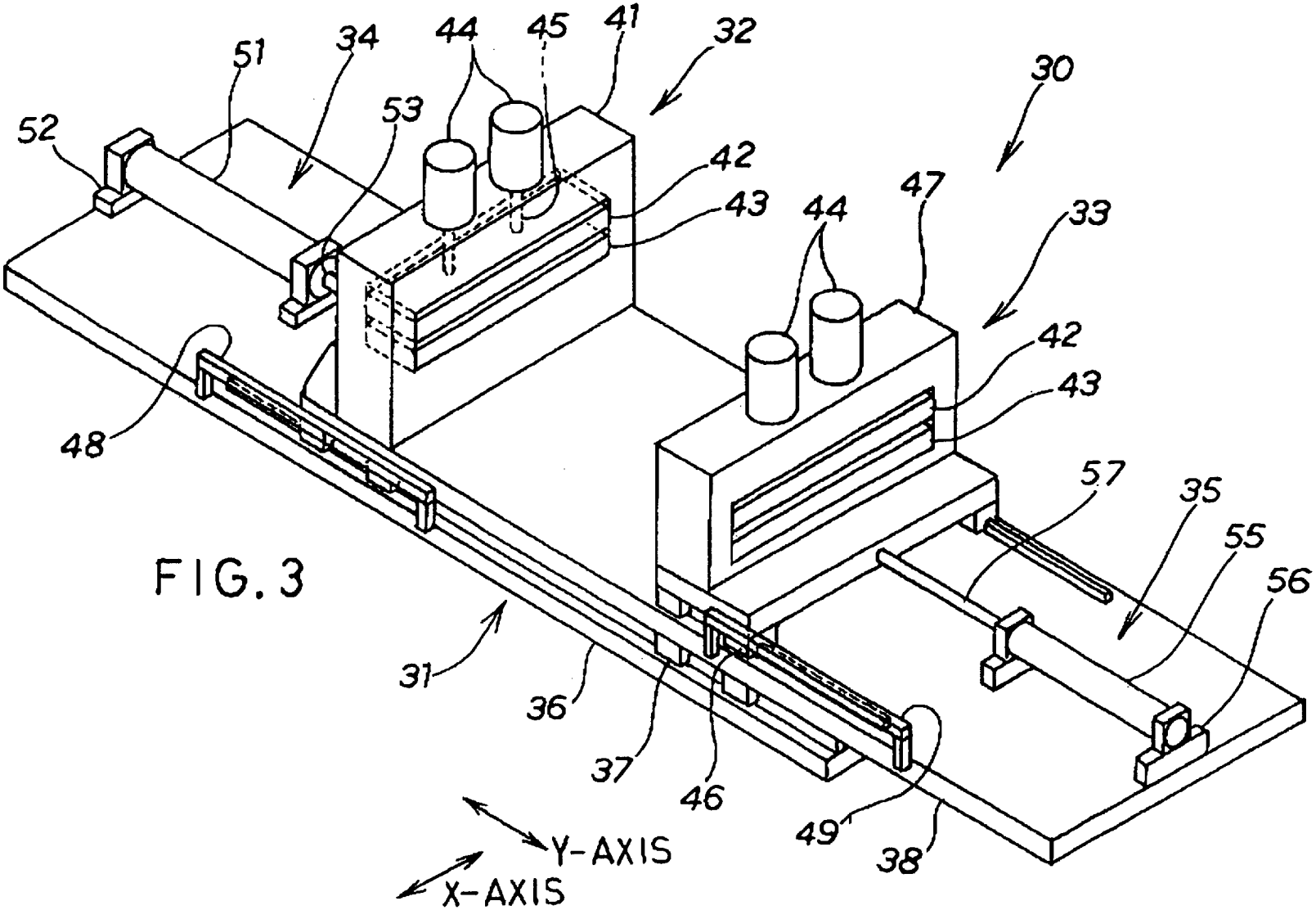
FIG. 3 is a perspective view showing the tension apparatus as illustrated in FIG. 2.

FIG. 3 is a perspective view of the tension apparatus 30. The tension apparatus 30 comprises a left clamping means 32, a right clamping means 33 and tension imparting means 34, 35, which are placed on a traveling table 31. The traveling table 31 is has a Y-axis movement base 38 fitted to a base 36 via a first guide 37.

The left clamping means 32 comprises a housing 41 provided on a left side of the Y-axis movement base 38. An upward pressing portion 42 is mounted vertically movably to a central part of the housing 41 via a guide. A downward pressing portion 43 is mounted in opposed relation to the upward pressing portion 42. On an upper part of the housing 41, a pair of hydraulic cylinders 44, 44 is provided. A rod 45 of the hydraulic cylinder 44 is mounted on the upward pressing portion 42 for hydraulically pressing the upward pressing portion 42 against the downward pressing portion 43.

The right clamping means 33 includes a housing 47 mounted via a second guide 46 on a right side of the Y-axis movement base 38. Similarly to the left clamping means 32, an upward pressing portion 42, a downward pressing portion 43 and a pair of hydraulic cylinders 44, 44 are provided on the housing 47. Reference numeral 48 denotes a left clamp position detector. Reference numeral 49 denotes a right clamp position detector. The left and right clamp position detectors 48, 49 may be a linear encoder or a linear position sensor.

The tension imparting means 34 comprises the hydraulic cylinder 51. A mounting portion 52 is mounted on the base 36 and a rod 53 is mounted on the Y-axis movement base 38.

The tension imparting means 35 comprises the hydraulic cylinder 55. Amounting portion 56 is mounted on the Y-axis movement base 38 and a rod 57 is mounted on the right clamping means 33.

Figure 4:
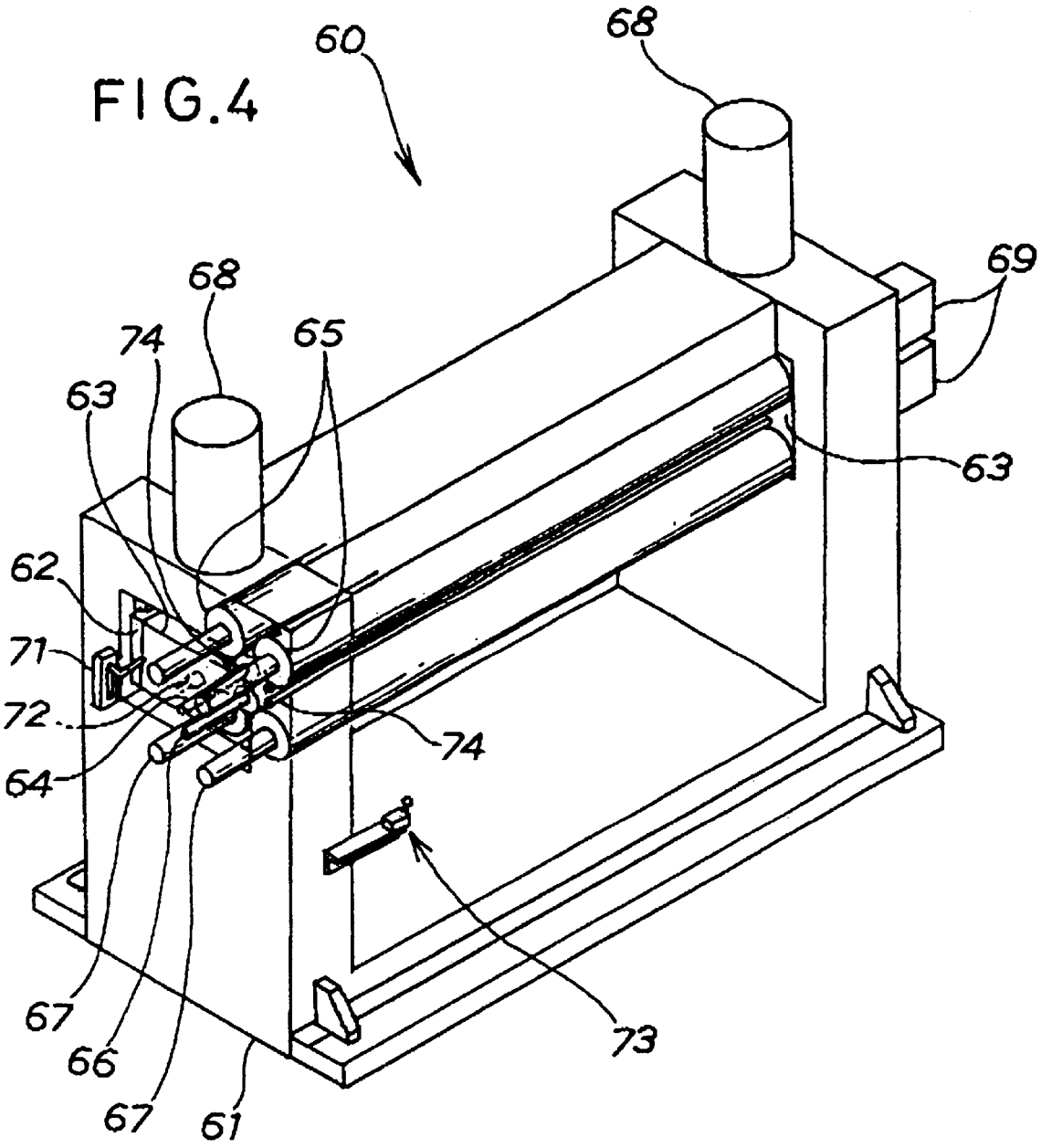
FIG. 4 is a perspective view showing the rolling means as illustrated in FIG. 2.

FIG. 4 is a perspective view showing the rolling means 60 illustrated in FIG. 2. The rolling means 60, which comprises a single rolling mill with six rolls, allows bearing cases 63, 63 to fit in a stand 61 vertically moveable via third guides 62, 62 (front side one not shown for clarity). The bearing cases 63, 63 allow a work roll 64 and backup rolls 65, 65 to fit therein via a bearing not shown. The stand 61 allows a work roll 66 and backup rolls 67, 67 to fit therein symmetrically with respect to these rolls 64, 65, 65 via a bearing not shown. The stand 61 is fitted on the upper side with pressure hydraulic cylinders 68, 68. Rods of the pressure hydraulic cylinders 68, 68 are mounted on the bearing cases 63, 63. The work rolls 64, 66 fit in driving portions 69, 69. Reference numerals 71, 72 and 73 designate a work roll position detector, left clamp movable limit detector and right clamp movable limit detector, respectively. 74, 74 denote heating means.

The work roll position detector 71 may be a linear encoder or a linear position sensor. The left clamp movable limit detector 72 and right clamp movable limit detector 73 may be a limit switch. The heating means 74 may be a heat source (heater) employing electromagnetic induction heating (induction heating) and is installed on both the left and right sides of the work rolls 64, 66 (see FIG. 5D).

Discussion will be made next as to an operation of the rolling apparatus 14 according to the first embodiment with reference to FIG. 5A through FIG. 5D.

Figure 5A:
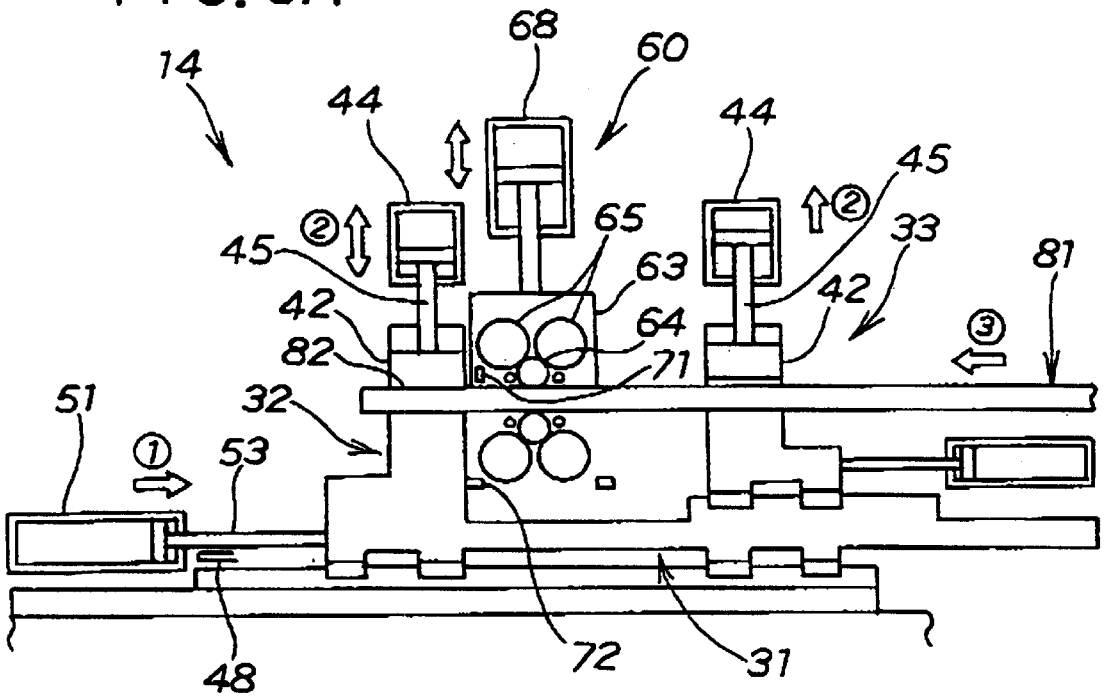
FIG. 5A to FIG. 5D are schematic views illustrating the mode of formation of a thin walled portion having a predetermined width perpendicular to the length of the steel strip by the use of the rolling apparatus according to the first embodiment.

As shown in FIG. 5A, a steel strip 81 is passed through the rolling apparatus 14. Advance movement (in a direction of arrow ①) of the rod 53 of the hydraulic cylinder 51 causes the left clamping means 32 to reach a predetermined position. At this time, the left clamping means 32 is prevented from overrunning by the left clamp movable limit detector 72.

As the hydraulic cylinders 44, 44 (rods) of the left and right clamping means 32, 33 retreat (in directions of arrows ②, ②), the upward pressing portion 42 ascends. On the other hand, as the rod of a downward-pressing hydraulic cylinder 68 for the rolling means 60 retreats. the work roll 64 and backup rolls 65. 65 ascend along with the bearing case 63.

After the steel strip 81 is passed through the rolling apparatus 14 up to the left clamping means 32 in a direction of arrow ③, the upward pressing portion 42 of the left clamping means 32 is caused to descend so that it grasps a thick walled portion 82 of the steel strip 81. Next, the hydraulic cylinder 68 is operated to press down the work roll 64 and backup rolls 65, 65 against the steel strip 81. The position to which the work roll 64 is pressed down is detected by the work roll position detector 71.

Figure 5B:
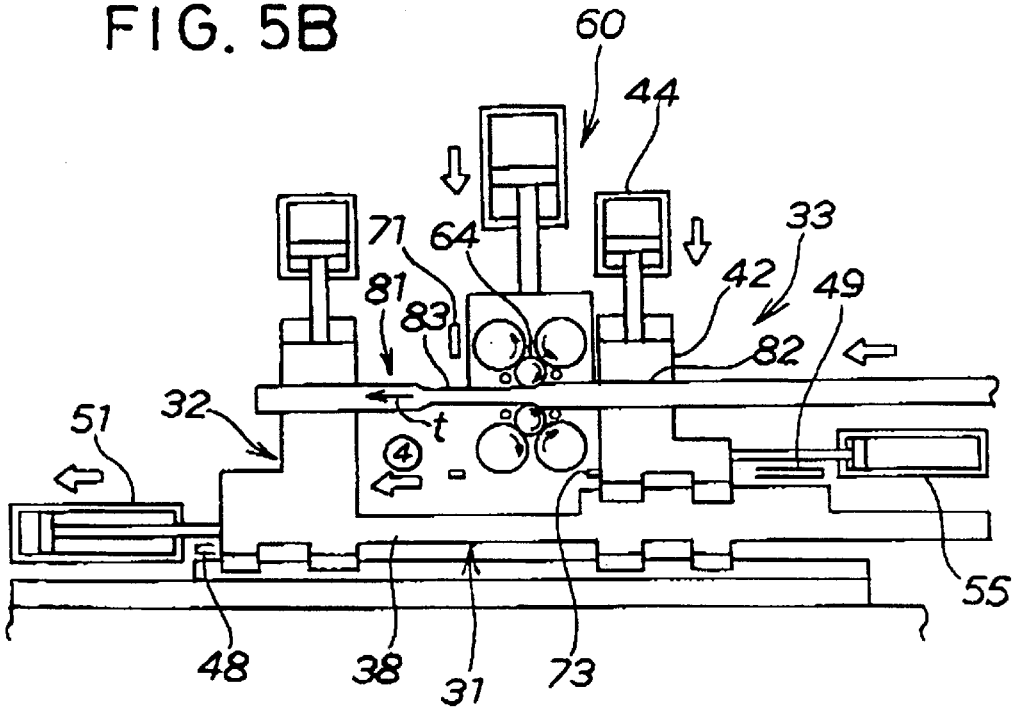

In FIG. 5B, a thin walled portion 83 is formed by driving and rotating the work roll 64 at a predetermined rolling speed. Simultaneously, by moving the left clamping means 32 toward the tension direction (direction of arrow ④), a thin walled portion 83 is formed while imparting a given tension t to the steel strip 81. The left clamping means 32 is stopped on reaching a predetermined position.

Subsequently, to reverse the direction of rotation of the rolling means 60, the right clamping means 33 is brought to the vicinity of the rolling means 60. The upward pressing portion 42 is caused to descend by the hydraulic cylinder 44 on the right clamping means 33 so that it grasps the thick walled portion 82 of the steel strip 81, whereupon the position of the right clamping means 33 is detected by the right clamp movable limit detector 73.

Figure 5C:
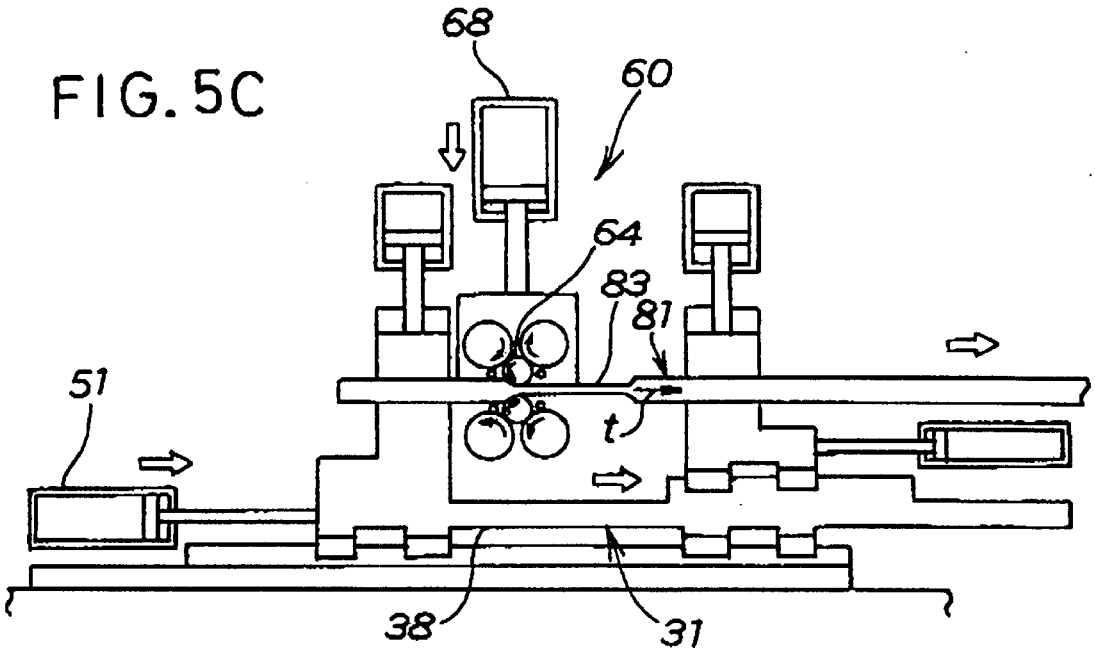
Figure 5D:
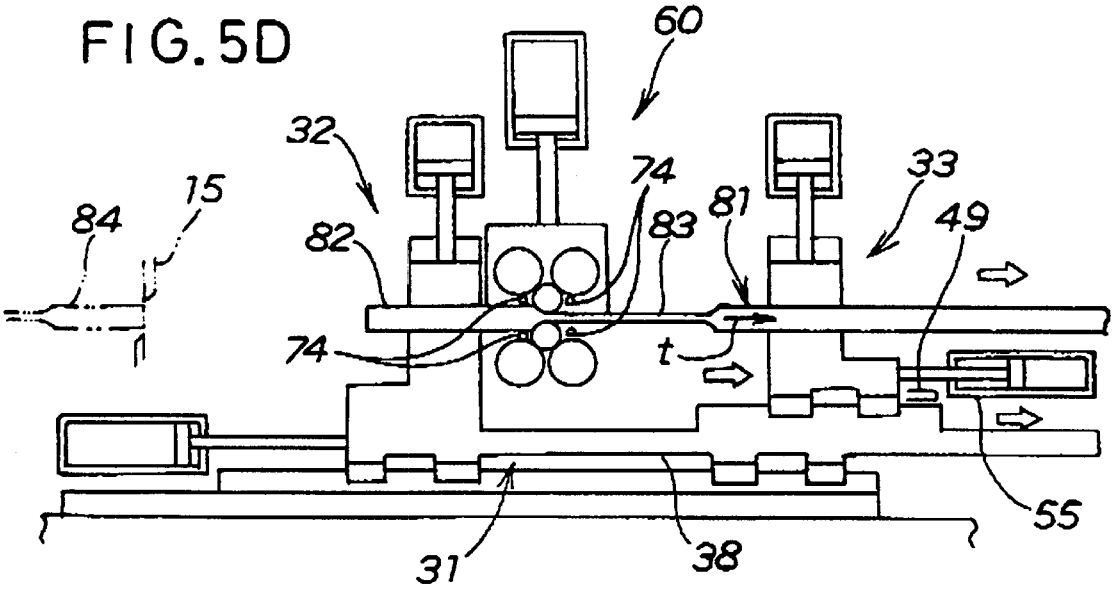

In FIG. 5C, the work roll 64 of the rolling means 60 is rotated in the reverse direction to make the thin walled portion 83 thinner. At this time, the work roll 64 is further pressed downward by the hydraulic cylinder 68 to adjust the roll distance. Simultaneously, the Y-axis movement base 38 is reverse moved toward upstream by the hydraulic cylinder 51. As the steel strip 81 is moved by the reverse movement to the upstream side, the movement quantity which causes sagging of the steel strip 81 is absorbed by the loop apparatus 13 (see FIG. 2).

Turning now to FIG. D,during reversal movement of the Y-axis movement base 38, the right clamping means 33 is moved by the hydraulic cylinder 55 on the Y-axis movement base 38, whereby a given tension is imparted to the steel strip 81. At this time, the position of the right clamping means 33 is detected by the right clamp position detector 49.

Figure 6:
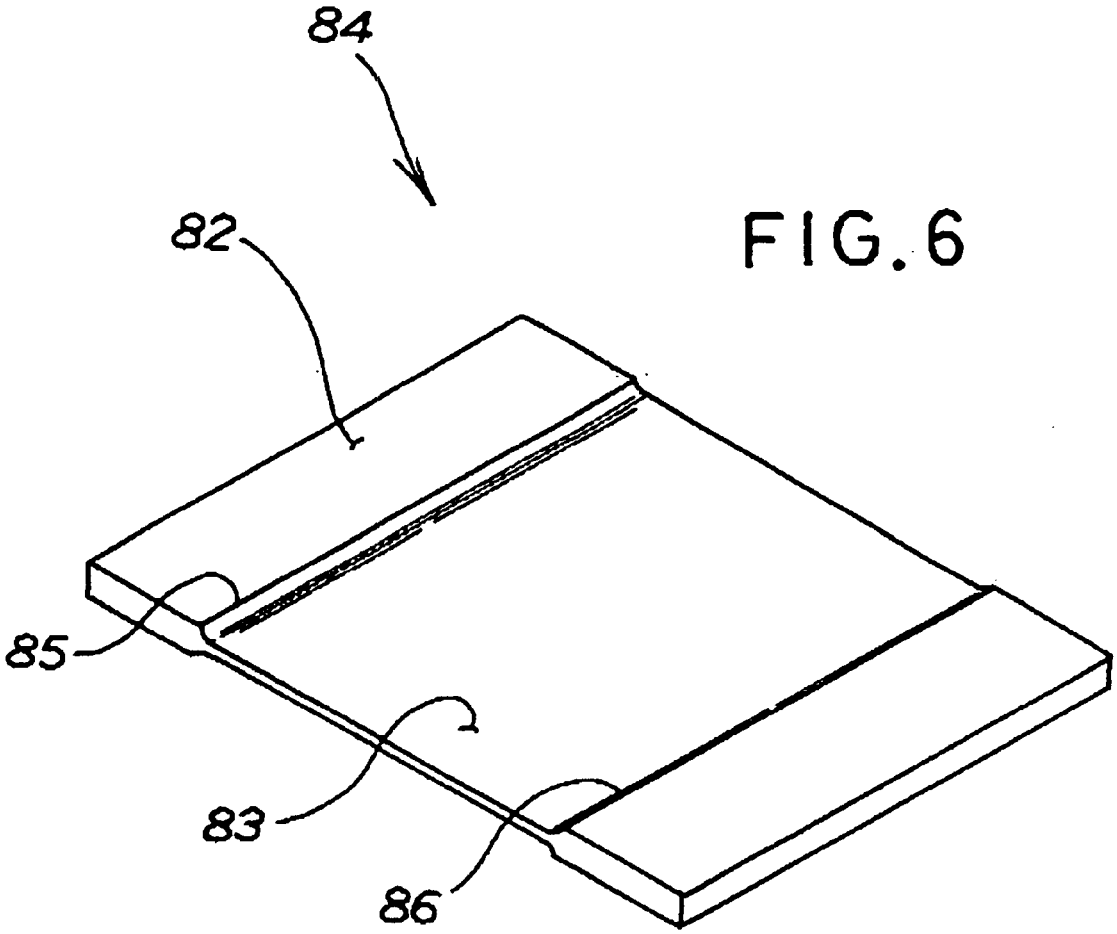
FIG. 6 is a perspective view showing a blank material having a thin walled portion formed by using the rolling apparatus according to the first embodiment.

Thereafter, the formation of the thin walled portion 83 as illustrated in FIG. 5A through FIG. 5D is further repeated to obtain the blank material 84 with the thin walled portion 83 of desired thickness (see FIG. 6).

Specifically, rolling work is performed while the steel strip 81 is grasped by the left and right clamping means 32, 33 and the tension t is applied to the steel strip 81. The tension t, when applied to the thin walled portion 83, makes it possible to extremely easily form the thin walled portion 83 on part of the thick walled portion 82 of the steel strip 81. As a result, a high degree of control is not required for the rolling means. Moreover, the tension t makes it possible to prevent wrinkles and bends that are likely to be generated on the thin walled portion 83.

Further, since the heating means 74, 74 are installed on the left and right sides of the rolling means 60, induction heating of the steel strip 81 is made possible. As a result, the steel strip 81 can be easily worked and rolled in a short period of time. In addition, it is made possible to work harden the steel strip 81 and to cause annealing action in the material, thereby reducing the cost of production of the material.

FIG. 6 is a perspective view showing a blank material in which a thin walled portion is formed by the above-mentioned rolling apparatus 14. In the blank material 84, there are formed the thin walled portion 83 on part of the thick walled portion 82 of the plate material and border lines 85, 86 perpendicular to the longitudinal direction. Such forming is particularly suited to the portion in which the border lines 85, 86 are used at right angles.

However, it is often desired that the border lines be provided non-perpendicularly to the longitudinal direction. Thus, with reference to FIG. 7 to FIG. 10G, discussion will be made as to a rolling apparatus according to a second embodiment for forming a blank material in which the border lines are non-perpendicular to the longitudinal direction. Herein, like reference numerals will be used for corresponding parts and their discussion will be omitted.

Figure 7:
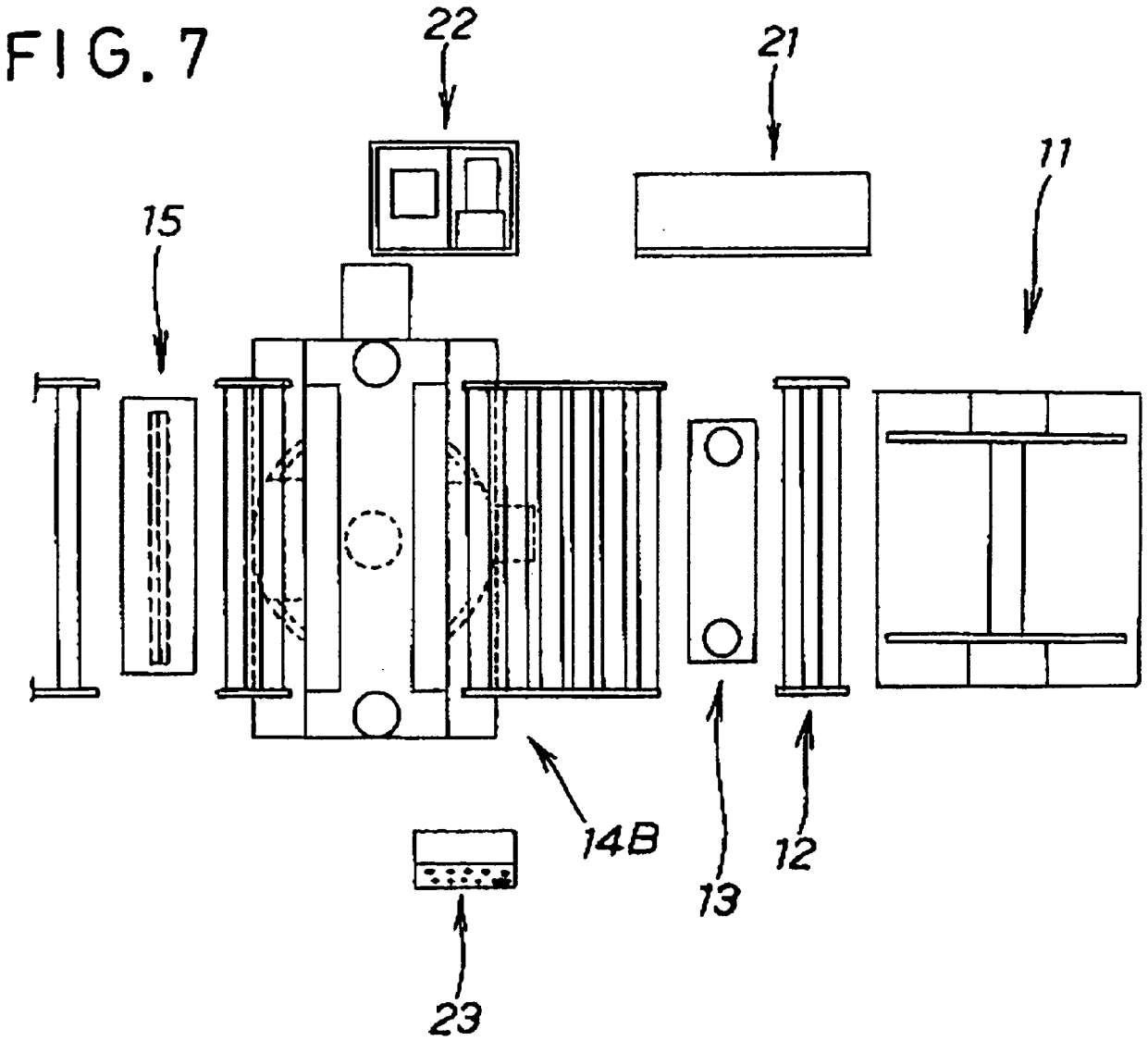
FIG. 7 is a top plan view showing a steel strip production line including a rolling apparatus according to a second embodiment of the present invention.
Figure 8:
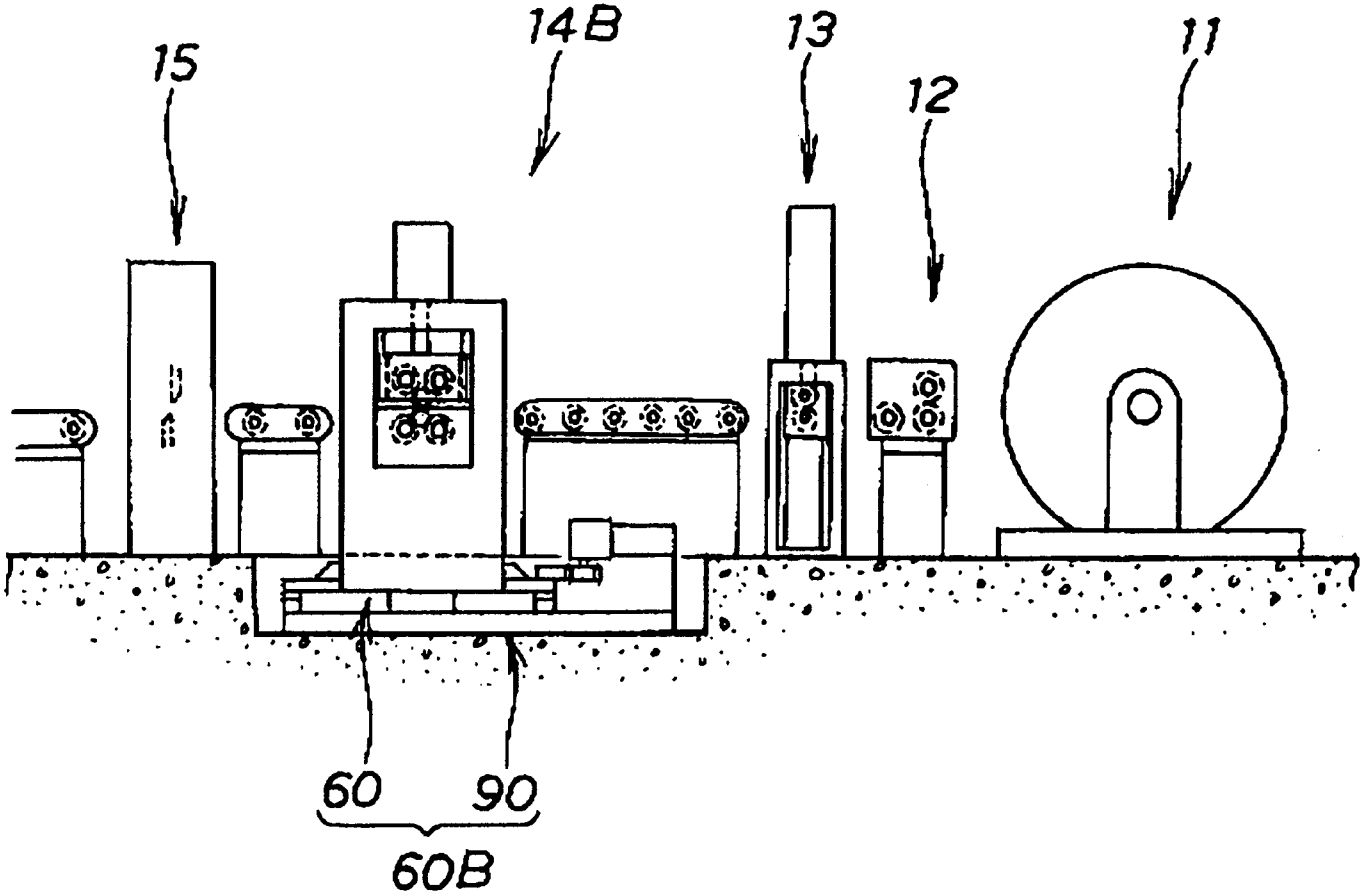
FIG. 8 is a front elevational view of FIG. 7.

As shown in FIGS. 7 and 8, a differential thickness plate production line comprises a feed reel 11 provided on an upstream side, a guide portion 12 provided on a downstream side of the feed reel 11, a loop apparatus 13 disposed on a downstream side of the guide portion 12, a rolling apparatus 14B provided adjacent to the loop apparatus 13 and a cutting machine 15 provided on a downstream side of the rolling apparatus 14B.

The rolling apparatus 14B according to the second embodiment is equipped with a rolling unit 60B which has a rolling means 60 and a turntable 90 rotatably supporting the rolling means 60.

Figure 9:
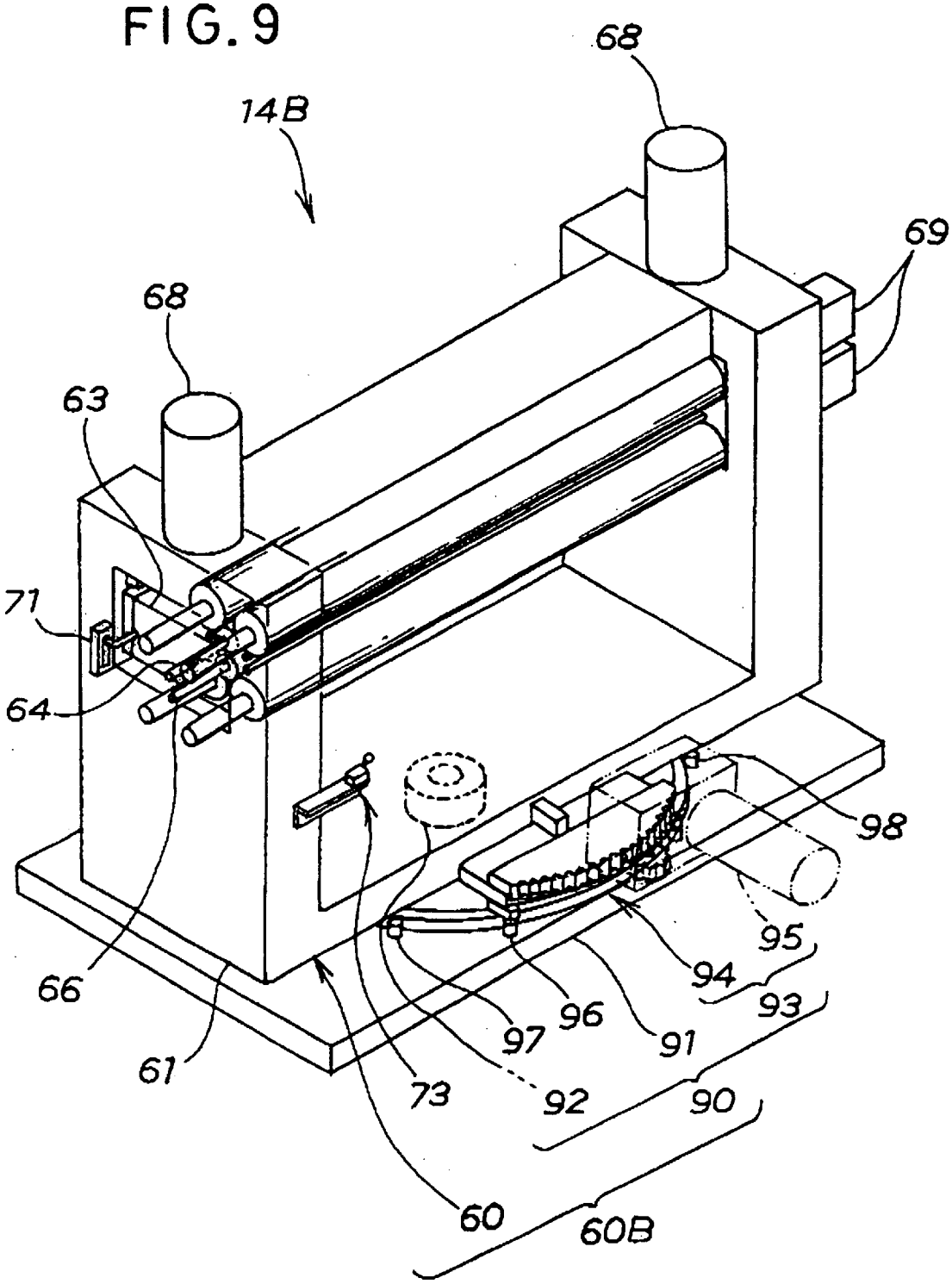
FIG. 9 is a perspective view showing a rolling unit in which rolling means shown in FIG. 8 is mounted by means of a turntable.

FIG. 9 is a perspective view showing the rolling apparatus 14 according to the second embodiment shown in FIG. 8.

As shown in FIG. 9, the turntable 90 comprises an erection table 91, a rotation support member 92 installed at a center of the erection table 91 and a driving member 93 for effecting rotation of the rolling means 60. The driving member 93 comprises a guide 94 fitted to the rolling means 60 and a worm reduction gear 95 for driving the guide 94.

The rolling means 60 is rotatably mounted on the erection table 91 via a rotation support member 92. That is, the rolling means 60 is placed rotatably on the turntable 90. Reference numerals 96, 97 and 98 designate an original position detector, a clockwise rotation limit detector and a counterclockwise rotation limit detector, respectively.

Next, an operation of the rolling apparatus according to the second embodiment will be discussed with reference to FIG. 10A through FIG. 10G.

Figures 10A, 10B, 10C:
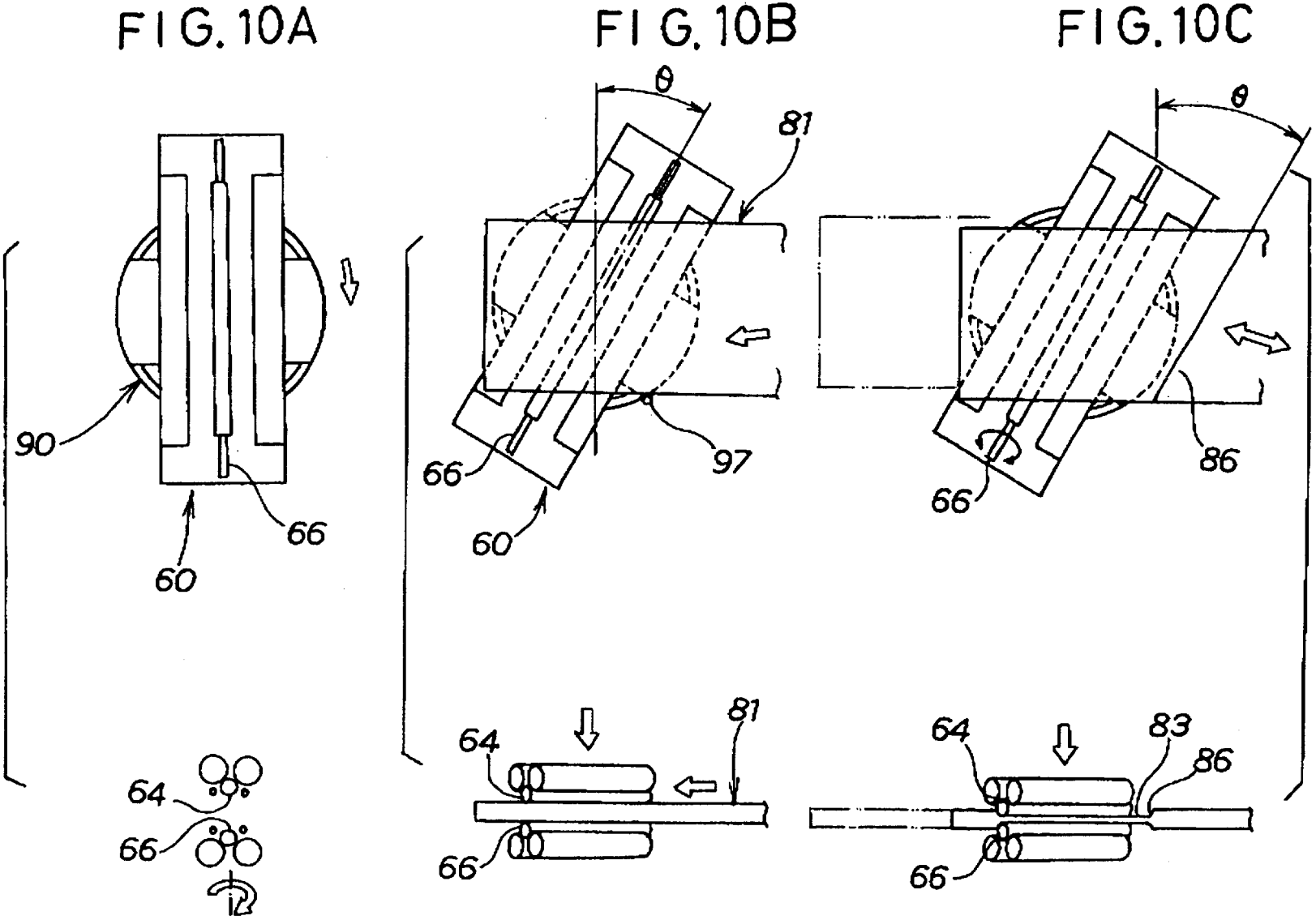
FIG. 10A to FIG. 10G are schematic views illustrating a mode of formation of a thin walled portion in the form of a trapezoid on the steel strip by using the rolling apparatus according to the second embodiments shown in FIG. 9.

As shown in FIG. 10A, the rolling means 60 is swiveled clockwise by the turntable 90, as indicated by an arrow, and is locked at a predetermined position.

Turning to FIG. 10B, the rolling means 60, when swiveled by a swiveling angle θ, is stopped and simultaneously locked by a positioning pin not shown. In this manner, the axes of the upper and lower work rolls 64, 66 are set non-perpendicularly to the longitudinal direction of the steel strip 81. At this time, the position of the swiveled rolling means 60 is detected by the clockwise rotation limit detector 97. Thereafter, the steal strip 81 is passed between the work roll 64 and the work roll 66 to press down the work roll 64.

In FIG. 10C, the work rolls 64, 66 are rotated. Specifically, simultaneously with the pressing down of the work roll 64, the work rolls 64, 66 are rotated in normal and reverse directions repeatedly so as to reciprocate the thin walled portion 83, whereby the thin walled portion 83 is repeatedly moved in such a manner as shown by imaginary lines to be gradually rolled to a thinner state, with the result that the borderline 86 forms an angle of θ. FIG. 10D illustrates that the borderlines 85, 86 of the thin walled portion 83 are formed at an angle of θ.

Figure 10E:
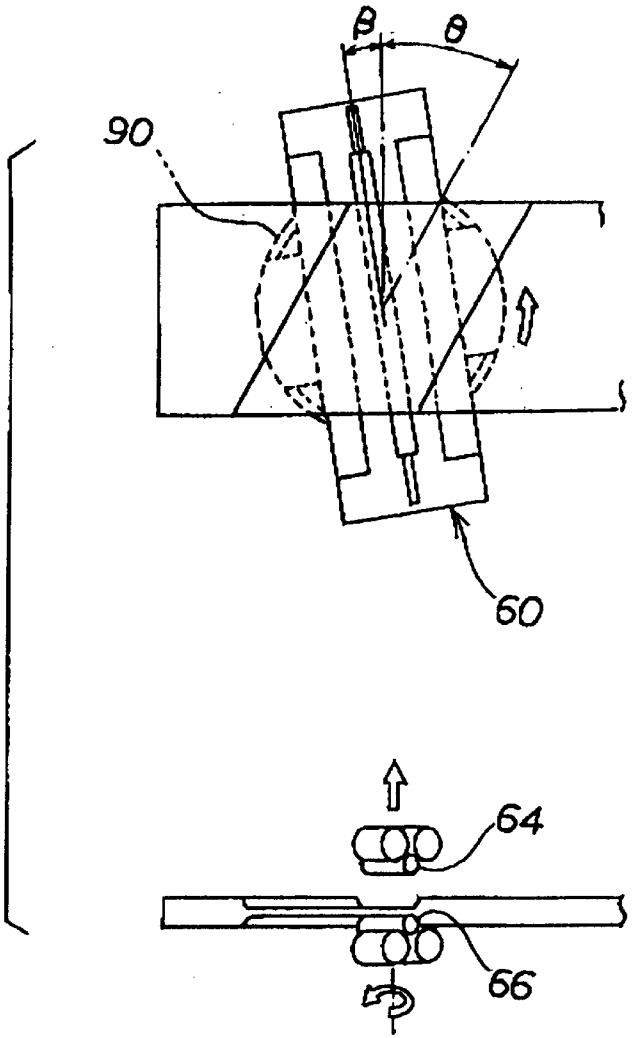
Figure 10D:
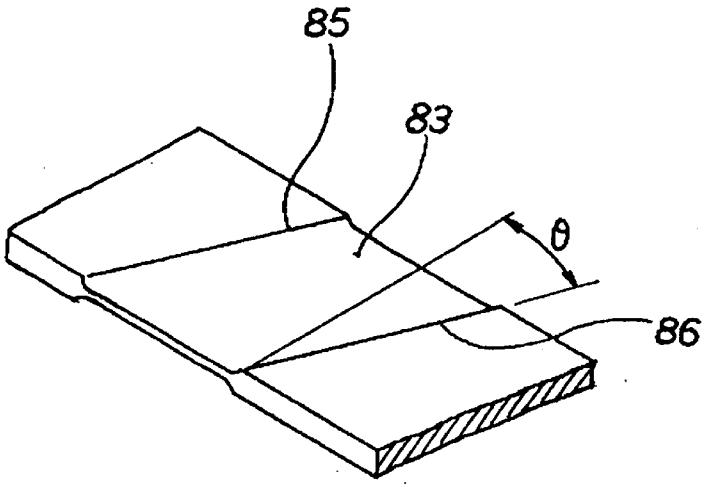

In FIG. 10E, the work roll 64 once ascends (at the same time, unlocks a lock pin not shown), and the rolling means 60 is swiveled by the turntable 90 as shown by an arrow. That is, the turntable 90 returns back by an angle of θ, continuously swivels by an angle of β, and locks.

Figure 10G:
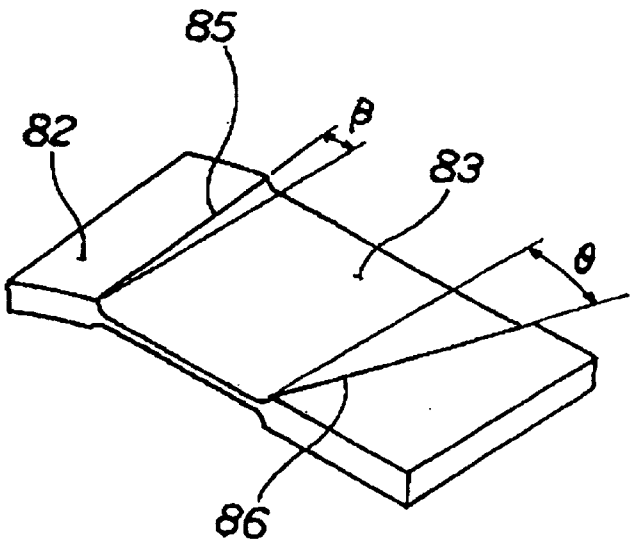
Figure 10F:
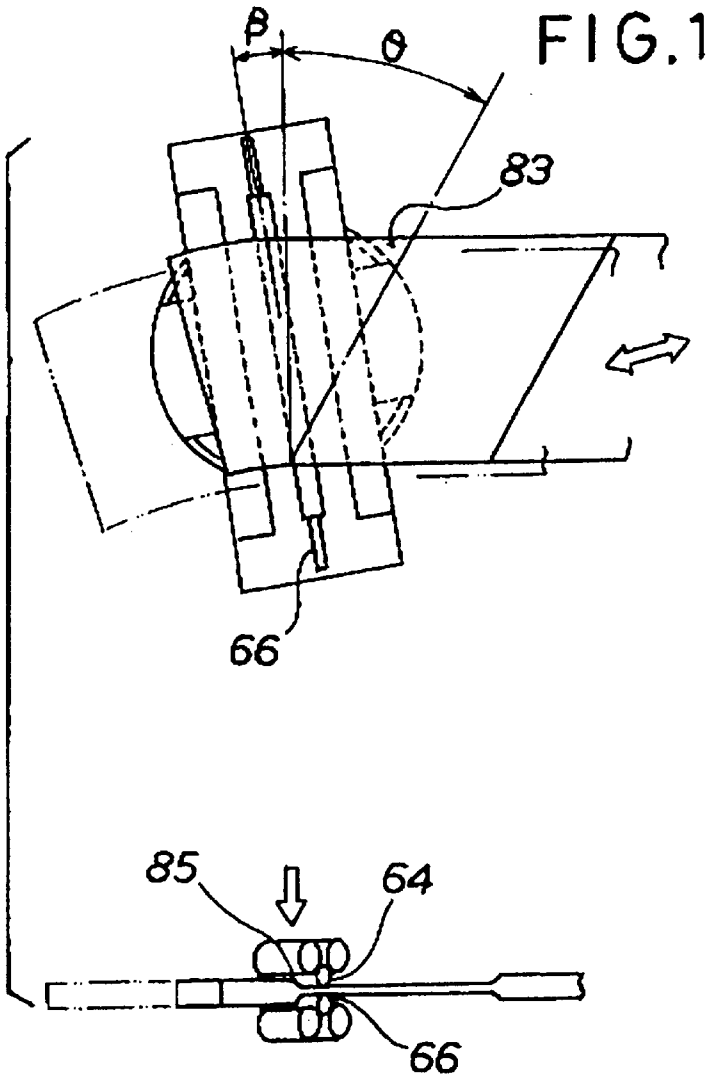

Turning to FIG. 10F, after swiveled by a swiveling angle of β (locking a lock pin), the work roll 64 is pressed down, and likewise reciprocates the thin walled portion 83, whereby the thin walled portion 83 is formed with the result that the borderline 85 can be formed at an angle of β.

FIG. 10G illustrates a blank material in which the borderline 85 is formed at an angle of β, and that the borderline 86 is formed at an angle of θ, namely, the thin walled portion 83 can be formed in trapezoidal shape on the blank material.

As is illustrated in FIG. 7 to FIG. 10G, it is made possible to form borderlines at angles of β and θ on the steel strip by placing the rolling means on the turntable.

Referring now to FIG. 11 to FIG. 13C, discussion will be made as to a rolling apparatus according to a third embodiment of the present invention, which is capable of efficiently forming blank materials whose borderlines are non-right-angled. Herein, like components as shown in the first and second embodiments will be designated by like reference numerals and their description will be omitted.

Figure 11:
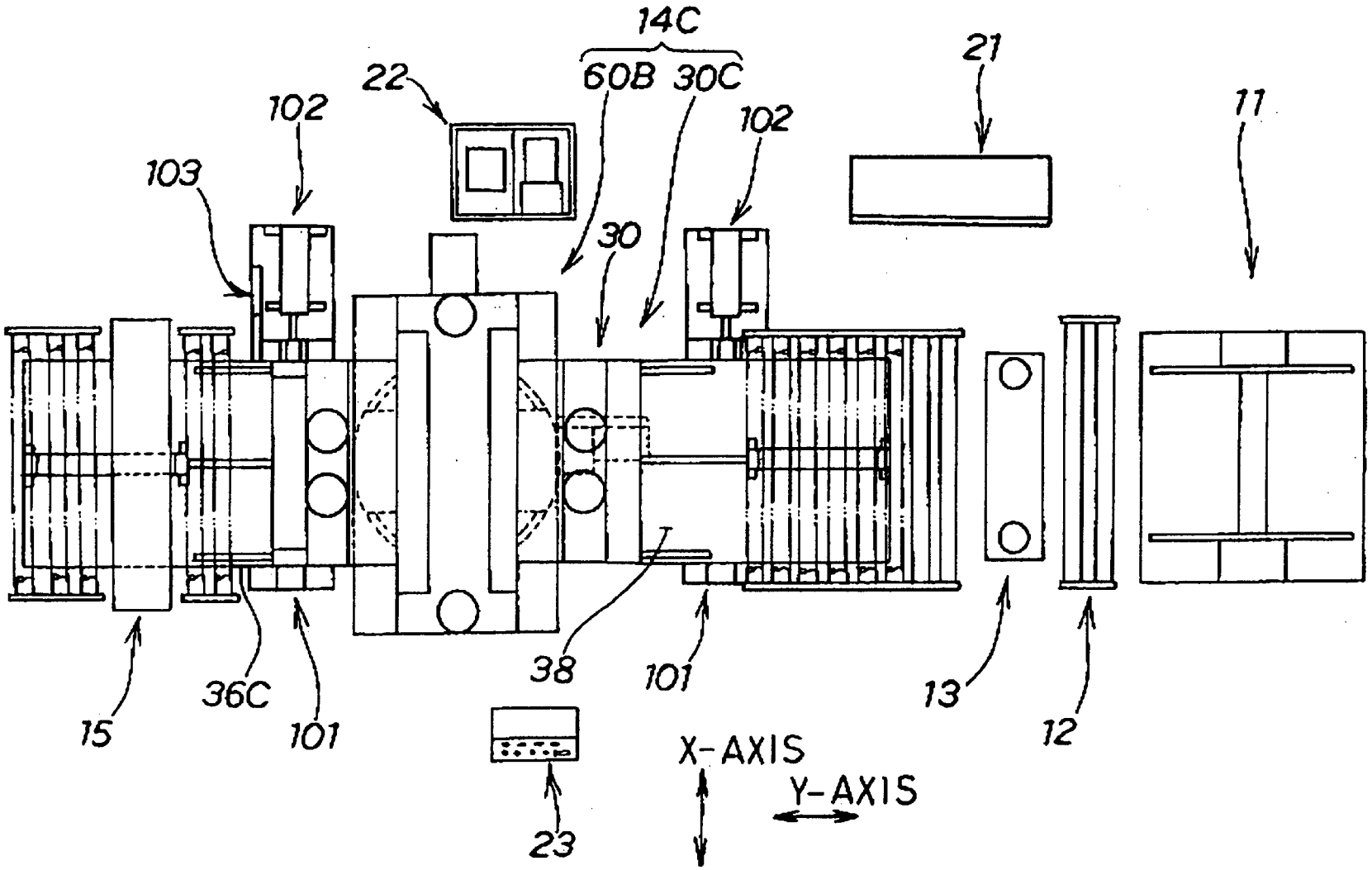
FIG. 11 is a top plan view showing a steel strip production line including a rolling apparatus according to a third embodiment of the present invention.
Figure 12:
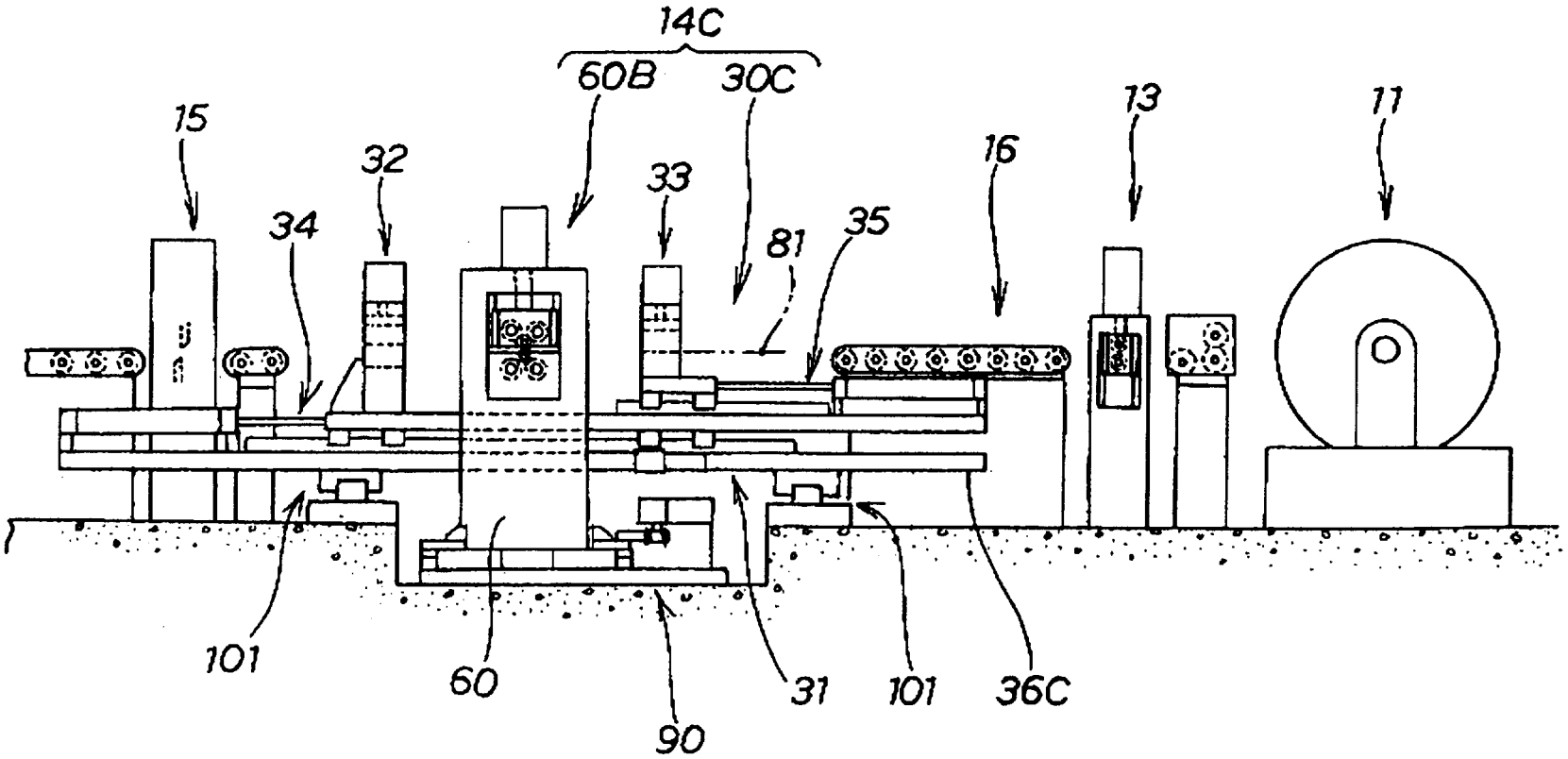
FIG. 12 is a front elevational view of FIG. 11.

As shown in FIG. 11 and FIG. 12, a production line including a rolling apparatus according to the third embodiment comprises a feed reel 11, a guide portion 12, a loop apparatus 13, a rolling apparatus 14C and a cutting machine 15 arranged in this order from upstream to downstream of the line.

The rolling apparatus 14C of the third embodiment is comprised of a tension unit 30C and a rolling unit 60B.

The tension unit 30C, which is capable of moving a tension apparatus 30 in the direction of X-axis, comprises X-axis movement guides 101, 101, an X-axis movement base 36C placed on the X-axis movement guides 101, 101, X-axis driving means 102, 102 for moving the X-axis movement base 36C in the direction of X-axis, and an X-axis movement position detector 103. The X-axis movement base 36C is placed on the X-axis movement guides 101, 101.

Next, operation of the rolling apparatus according to the third embodiment will be described with reference to FIG. 12 and FIG. 13A through FIG. 13C.

Figure 13A:
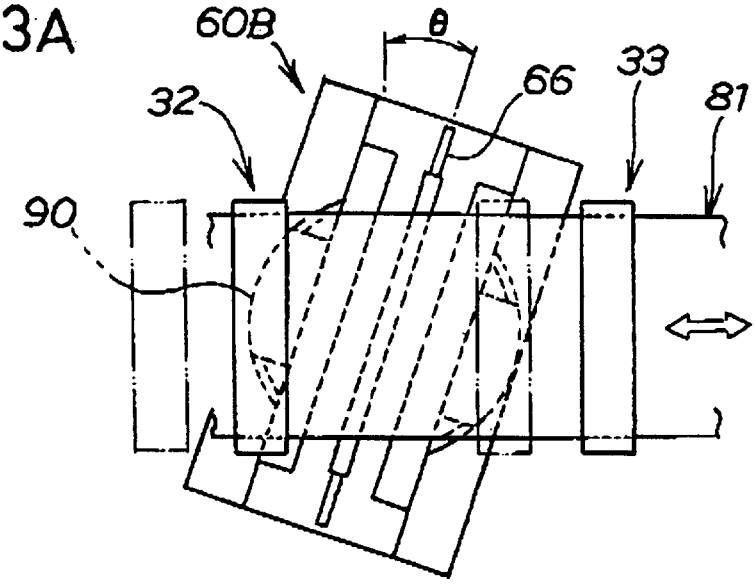
FIG. 13A to FIG. 13C are schematic views illustrating a mode of formation of a thin walled portion in the form of a trapezoid on the steel strip by using the rolling apparatus according to the third embodiment.

As shown in FIG. 13A, the rolling means 60 is swiveled by the turntable 90, and the axis of the work roll 66 is set at a non-right angle. Namely the work roll 66 can be set at a swiveling angle of θ.

On the other hand, the left and right clamping means 32, 33 grasp the upstream and downstream sides of the steel strip 81 passed between the work rolls.

Figure 13B:
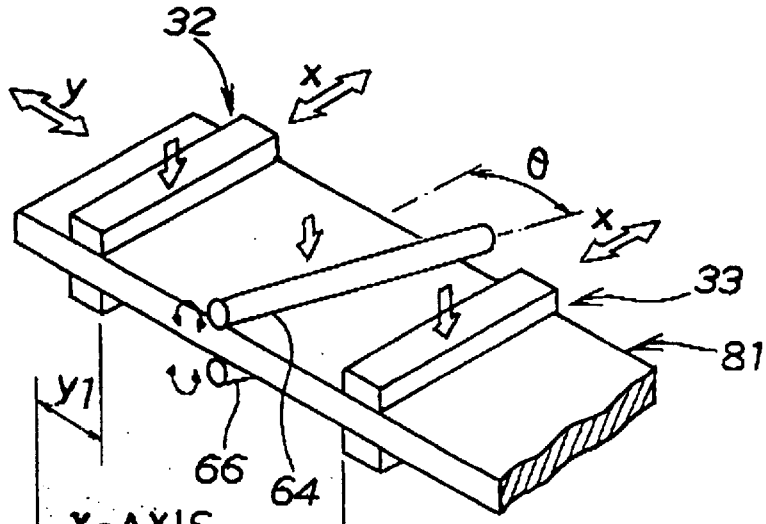

In FIG. 13B, the movements of the left and right clamping means 32, 33 are made to correspond to the swiveling angle by controlling the feed (direction of arrow x) of the X-axis movement base 36C (see FIG.11) and the feed (direction of arrow y) of the Y-axis movement base 38C, when the movement quantity of the X-axis movement bass 36C is detected by the X-axis movement position detector 103 (see FIG. 11).

Simultaneously, the work roll 64 is pressed down to drive the work rolls 64, 66. As a result, it is made possible to apply a predetermined tension to the steel strip 81 which is reciprocated by rotation of the work rolls 64, 66 at an angle of θ by using the left and right clamping means 32, 33.

Figure 13C:
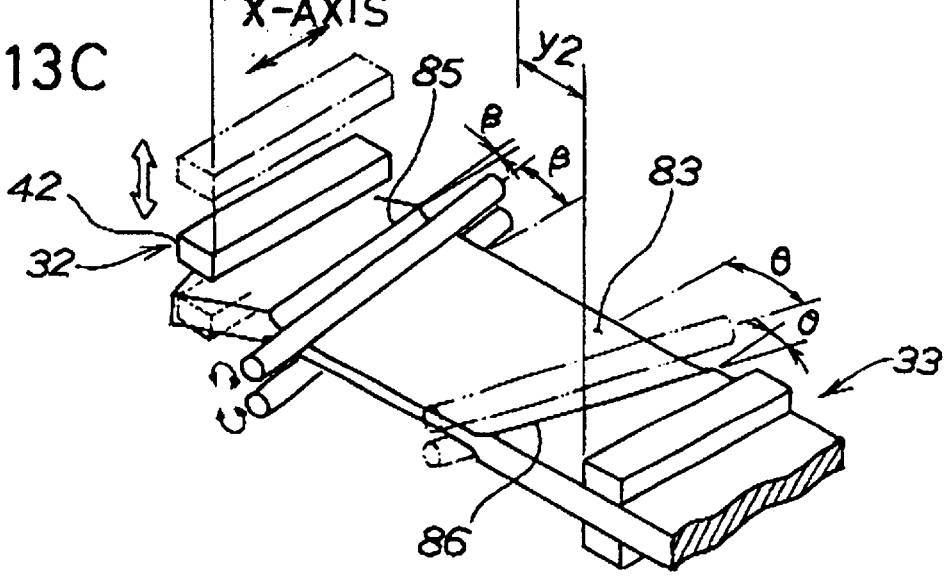

As shown in FIG. 13C, since a tension can be imparted by the left and right clamping means 32, 33, the thin walled portion 83 of angle θ and the borderline 86 can be formed in a short period of time. Similarly. the thin walled portion 83 of angle β and the borderline 86 can be formed in a short period of time.

Moreover, the right clamping means 33 moves and absorbs the elongation in the direction of Y-axis (distance y1+distance y2).

When elongation in the direction of X-axis is large. the left clamping means 32 is once returned to the original position by raising the upper pressing portion 42 as shown by the imaginary lines, thereby preventing insufficiency in the stroke of the X-axis driving means (hydraulic cylinder).

Figure 14:
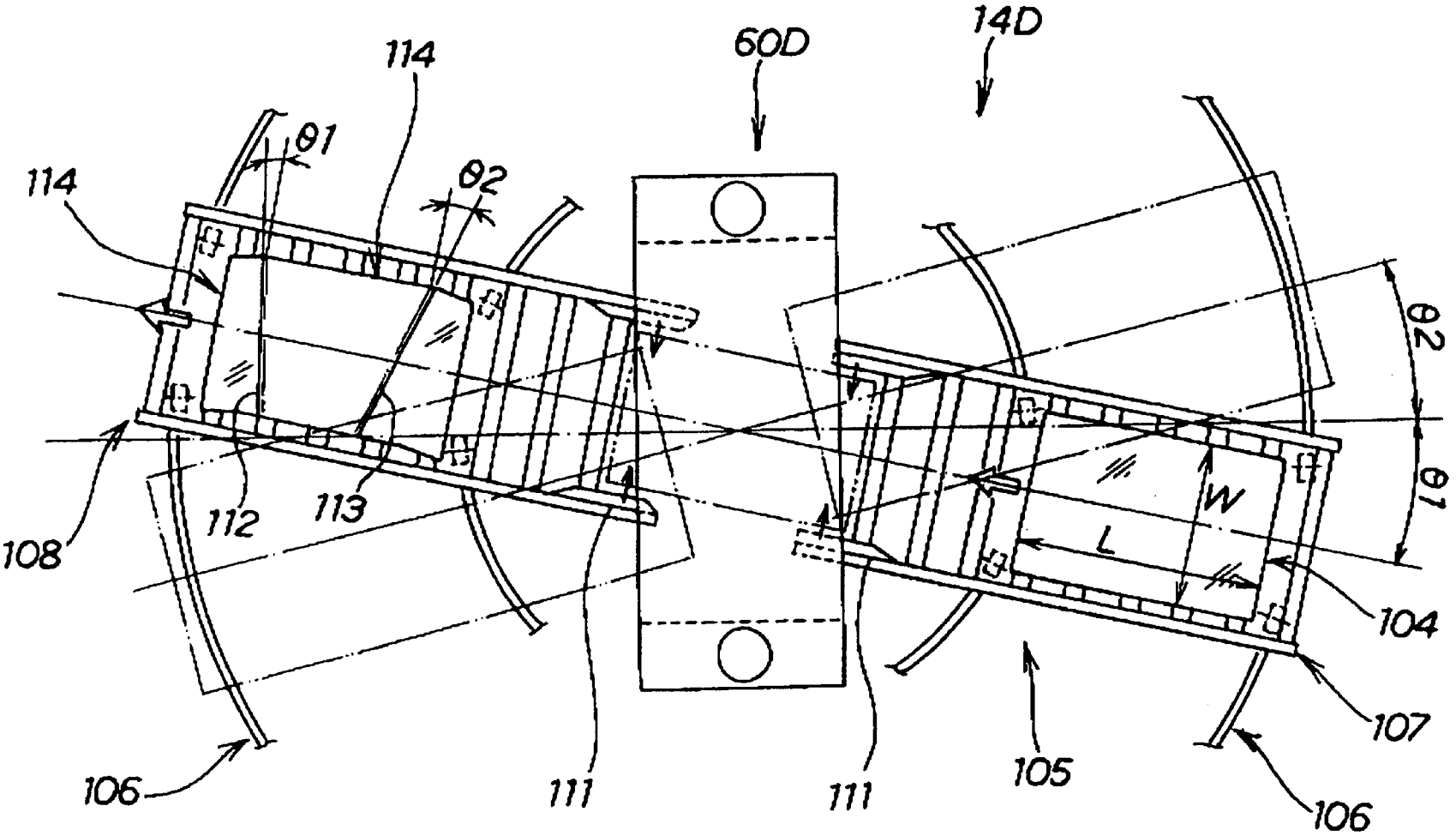
FIG. 14 is a schematic view illustrating a rolling apparatus according to a fourth embodiment according to the present invention, which apparatus is designed for forming a thin walled portion in the form of a trapezoid on a discontinuous steel strip of a given size.
Figure 15A:
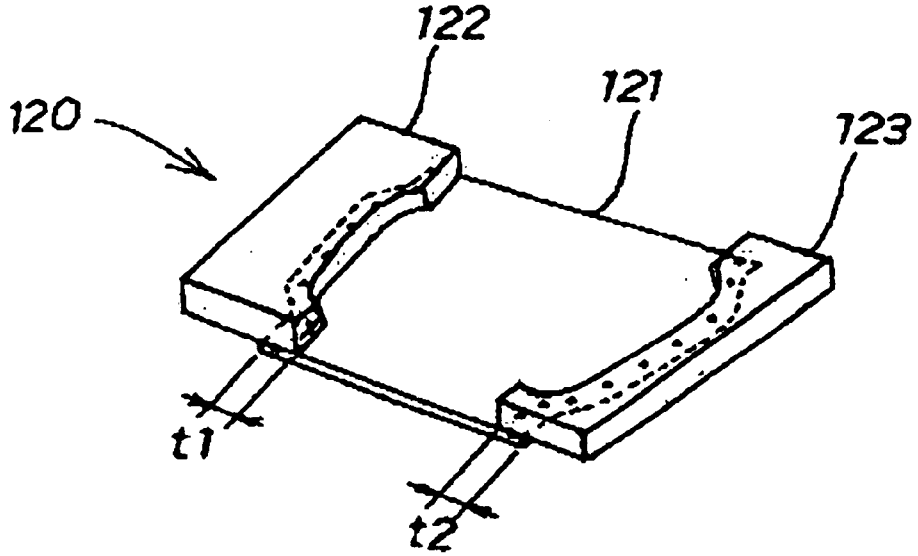
FIG.15A (PRIOR ART)
FIG. 15A and FIG. 15B are schematic views showing a conventional method of forming a thin walled portion on a plate material by bonding a plurality of plate materials by spot welding or laser welding together.
Figure 15B:
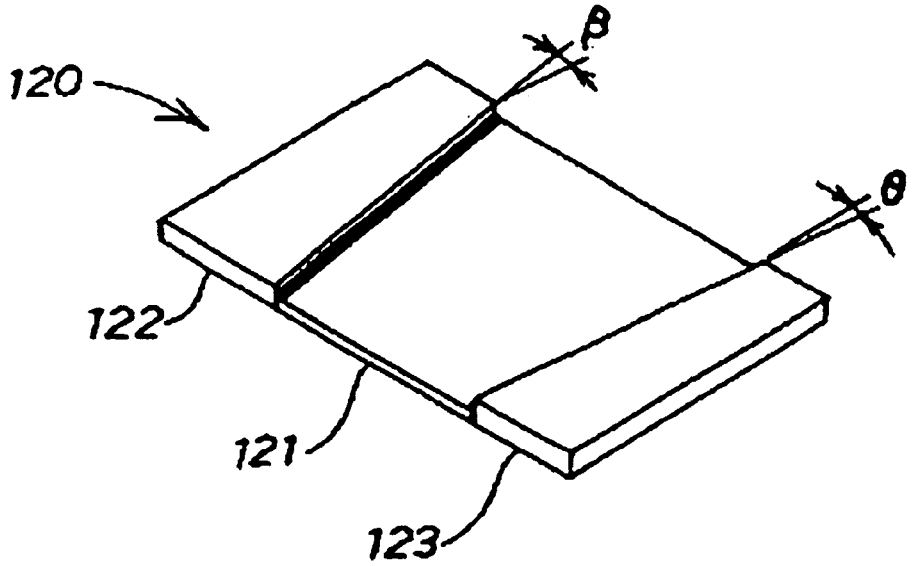
FIG.15B (PRIOR ART)

FIG. 14 illustrates a rolling apparatus according to a fourth embodiment of the present invention.

The rolling apparatus 14D according to the fourth embodiment comprises a rolling means 60D fixed to a floor and a swiveling means 105 for swiveling a plate material 104 to be passed through the rolling means 60D. The plate material 104 is formed by cutting steel strip having a width of W into a predetermined length.

The swiveling means 105 is comprised of rails 106, 106 laid on a floor, a carrying-in bogie 107 and a carrying-out bogie 108, both being placed on the rails 106, 106,and work positioning means 111, 111 movably disposed on the carrying-in bogie 107 and a carrying-out bogie 108.

Next, operation of the rolling apparatus according to the fourth embodiment will be described.

The rail 106 is formed in the shape of a circular arc at the center of the axis of the rolling means 60D, thereby enabling the carrying-in bogie 107 to be swiveled by a swiveling angle of θ about the rolling means 60D as a center. When the plate material 104 is placed on the swiveled carrying-in bogie 107, the work positioning means 111 moves in the direction of the arrow and causes the plate material 104 to stop at a predetermined position.

When the work roll of the rolling means 60D is pressed down, the work positioning means 111 movably releases the plate material 104, whereby the rolling means 60D can reciprocate the plate material 104, thus enabling the formation of a thin walled portion.

After the formation of the thin walled portion, the work positioning means 111 once grasps the plate material 104 and swivels to the position of θ as shown by imaginary lines, thereby enabling formation of the borderline 113 at an angle of θ. As a result, it becomes possible to obtain the blank material 114 having a non-right-angled thin walled portion.

In the fourth embodiment, the rolling means 60 is fixed to a floor, thus dispensing with a turntable and enabling to contrive space saving of the rolling means 60.

When the plate material 104 is placed on the carrying-in bogie 107, it is made possible, in the subsequent step, to form borderlines 112, 113 having angles of θ1, θ2, respectively, thus enabling the workers to put the steps of the upstream side into practice simultaneously with the steps of the downstream side and also enabling to contrive the curtailment of the production cost.

Although the tension imparting means 34, 35, as shown in FIG. 3, according to the first embodiment of the present invention are hydraulic cylinders 51, 55, those means are not limited thereto. They may be any of a pneumatic cylinder, a screw system which rotates ball screws with an electric motor, a chain system and a rack pinion system.

The swiveling angle of the rolling means 60 may be set at a desired angle by the use of a sensor such as a rotary encoder in the turntable 90 of the rolling unit 60B according to the second embodiment. Thereby it is made possible to stop the swiveling on the way (intermediate stoppage) instead of a swiveling limit with the result that further variety of blank materials becomes obtainable. Moreover, the turntable 90 as described hereinbefore is nothing more than an example, is not limited to this turntable technique, but only needs to be capable of swiveling the rolling means 60.

Likewise, the types of the detectors (sensors) and the mounting positions of the detectors (sensors) are each nothing more than one example, is not limited to these types, but are optional. For instance, there is no objection to the detection of the position of the left and right clamping means 32, 33 by mounting sensors on the hydraulic cylinders 51, 55 in the tension apparatus 30 as illustrated in FIG. 3.

Moreover, a sensor or sensors may be mounted in addition to the detectors as shown in the foregoing embodiments so as to carry out additional control work. For instance, the provision of a wall thickness detector, a tension detector or the like enables more precise control to be put into practice.

What is claimed is:

1. A rolling apparatus comprising:

a pair of clamping means for grasping a steel strip, said pair of clamping means being spaced from each other along the longitudinal extent of said steel strip;

tension imparting means for moving at least one of said pair of clamping means in a tension direction longitudinally to apply a predetermined tension to the steel strip grasped by said pair of clamping means;

a traveling table allowing said pair of clamping means and said tension imparting means to move reciprocally in unison longitudinally of the steel strip; and means for pressing with upper and lower rolling rolls the steel strip grasped by the pair of clamping means placed on said traveling table to thereby form a thin walled portion on a part of the steel strip, said pressing means having a driving member for driving the rolling roll against the steel strip to produce the thin walled portion as the strip is tensioned.

2. A rolling apparatus according to claim 1, further including a heating means for heating said steel strip on both upstream side and downstream side of at least one of said upper and lower rolling rolls.

3. A rolling apparatus comprising:

a pair of clamping means for grasping a steel strip, said pair of clamping means being spaced from each other along the longitudinal extent of said steel strip;

tension imparting means for moving at least one of said pair of clamping means in a tension direction longitudinally to apply a predetermined tension to the steel strip grasped by said pair of clamping means;

a traveling table allowing said pair of clamping means and said tension imparting means to move reciprocally in unison longitudinally of the steel strip;

means for pressing with upper and lower rolling rolls the steel strip grasped by the pair of clamping means placed on said traveling table; and a turntable for rotatably supporting said pressing means.

4. A rolling apparatus according to claim 3, further including a heating means for heating said steel strip on both upstream side and downstream side of at least one of said upper and lower rolling rolls.

* * * * *